United States Patent [19]

Kikuchi

[11] Patent Number: 4,475,097

[45] Date of Patent: Oct. 2, 1984

[54] FLYBACK TRANSFORMER

[75] Inventor: Akihiro Kikuchi, Nagaokakyo, Japan

[73] Assignee: Murata Manufacturing Co., Ltd., Nagaokakyo, Japan

[21] Appl. No.: 569,763

[22] Filed: Jan. 10, 1984

[30] Foreign Application Priority Data

Jan. 18, 1983 [JP] Japan ..... 58-5902[U]

[51] Int. Cl.[3] ..... H01F 15/10; H01F 27/26

[52] U.S. Cl. ..... 336/192; 336/198; 336/210

[58] Field of Search ..... 336/65, 192, 198, 208, 336/210, 96; 363/146

[56] References Cited

U.S. PATENT DOCUMENTS 2,800,620 7/1957 Ebbeler et al. ..... 336/198 X 4,246,636 1/1981 Kawamura et al. ..... 363/146

*Primary Examiner*—Thomas J. Kozma

*Attorney, Agent, or Firm*—Wenderoth, Lind & Ponack

[57] ABSTRACT

A flyback transformer has a primary coil on the bobbin and has fitting holders provided at both sides of a skirt formed integrally with a lower end of the primary coil bobbin. A U-shaped positioning fitting is provided at the center with a through bore and is fitted onto said skirt and fixed at both ends to the holders respectfully. A spring is fitted onto cores having legs inserted into the primary coil bobbin and abutting each other, and a grounding pin bent from the lower end of the spring is fitted into the bore of the positioning fitting. By this structure, the grounding pin is positioned properly with respect to the terminal pins for the primary winding with improved positioning accuracy, and insuring mounting of the grounding pin accurately on a printed substrate.

4 Claims, 8 Drawing Figures

FLYBACK TRANSFORMER

This invention relates to a flyback transformer, and more particularly to a flyback transformer which is capable of accurately positioning an earth or grounding pin provided on a coupling spring for the cores and a group of terminal pins provided on a bobbin for the primary winding.

Conventionally, a usual flyback transformer, as shown in FIG. 1, is so constructed that two U-shaped cores 11 are opposite to each other, at legs 12 of cores 11 is mounted a primary coil bobbin 14 of synthetic resin, on which a primary winding 13 is wound, a secondary coil bobbin 16 of synthetic resin having wound thereon a secondary winding 15 covers the outside surface of the primary winding 13, these windings are covered by a casing 17 of synthetic resin and molded therein with resin, and a group of terminal pins 19 for the primary winding are disposed in circle on a skirt 18 connected to the lower end of primary coil bobbin and housing a part of the lower core 11.

The pair of upper and lower cores 11 of U-shape are clipped on the outsides by a spring member 20 composed of thicker metal wire rod and bent in U-shape, the spring member 20 is bent at the lower end to form an earth or grounding pin 21 integral therewith, and the respective terminal pins 19 and earth pin 21 are inserted into the predetermined bores in a printed substrate so connect with the printed wirings, so that the flyback transformer is mounted on the substrate.

Such flyback transformer, however, is impossible on be mounted to the printed substrate unless the earth pin 21 is disposed with respect to the group of terminal pins 19 with high accuracy.

In other words, the group of terminal pins 19 are disposed with accuracy because they are embedded in the primary coil bobbin molded of synthetic resin.

On the contrary, the earth pin 21 is liable to be out of position due to the mounting of spring 20 onto the cores 11.

Hence, the conventional flyback transformer has positioned the earth pin in such a manner that a distance X between the common axis of legs 12 carrying the primary coil bobbin of cores 11, that is, the center of terminal pin group disposed in circle at the primary coil bobbin, and the earth pin 21, is defined by distance Y between the same and the corner of the core 11.

Such positioning method, however, may cause an error in the distance X due to variations in the mounting of spring 20 on the cores 11, so that it is difficult to regularize the position of earth pin 21.

Also, the earth pin 21 cannot be positioned with respect to a width Z of core 11 with high accuracy unless a guide groove for the spring 20 is provided in the lower surface of core 11, thereby requiring extra machining for the core 11.

Accordingly, an object of the invention is to provide a flyback transformer which can accurately position the earth pin of the spring for coupling the cores, with high accuracy with respect to the center of the group of terminal pins provided on the primary coil bobbin.

Another object of the invention is to provide a flyback transformer which is superior in the positional accuracy of earth pin and capable of being mounted on the printed substrate with accuracy.

Still another object of the invention is to provide a flyback transformer which can improve the positional accuracy of earth pin without machining the core.

The above and other objects and features of the invention will appear more fully hereinafter from a consideration of the following description taken in connection with the accompanying drawing wherein one embodiment is illustrated by way of example.

Figure 1:
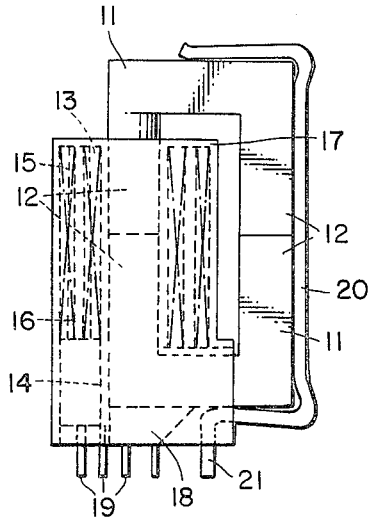
FIG. 1. (PRIOR ART)
FIG. 1 is a front view of the conventional flyback transformer.
Figure 2:
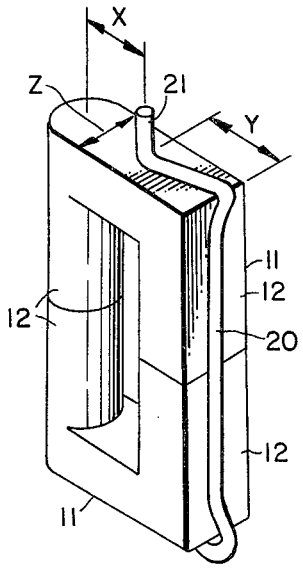
FIG. 2. (PRIOR ART)
FIG. 2 is a perspective view of the principal portion thereof.
Figure 3:
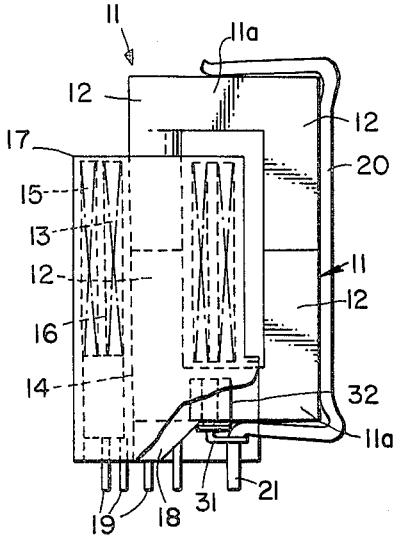
FIG. 3 is a partially cutaway front view of an embodiment of a flyback transformer of the invention.

Referring to FIG. 3, the primary coil bobbin 14, on the outer periphery of which the primary winding 13 is wound, is made of resin and is cylindrical, and a skirt 18 for containing therein the lower ferrite core 11 is formed of the same material as the bobbin 14 and provided integrally on the lower end thereof in relation of projecting perpendicularly to the axis of bobbin 14.

At the outer periphery of skirt 18, a group of terminal pins 19 connecting with lead wires of the primary winding and a lead wire of the secondary winding at the reference potential side are disposed in circle coaxial with the primary coil bobbin 14.

The primary winding is wound on the outer periphery of the primary coil bobbin 14 of synthetic resin and a secondary coil bobbin 16 of synthetic resin, on which a secondary winding 15 is wound, is fitted onto the primary winding 13.

The upper and lower ferrite cores 11 each are U-shaped and comprise a horizontal portion 11*a* and legs 12 at both ends thereof, one leg 12 of each core 11 being fitted into the primary coil bobbin 14 from both ends thereof and abutting against each other, and the cores 11 are coupled by a spring 20 fitted thereon along the outsides of the other legs 12 and the upper and lower horizontal portions 11*a*.

The spring 20 is formed of a thicker metal wire rod, such as stainless or piano wire, subjected to surface treatment, such as galvanization or tinning and bent in a U-shape, an earth or grounding pin 21 being bent from and integral with the lower end of spring 20. Fitting holders 32 for fixing positioning fitting 31 at both ends thereof are provided on the outer surface of skirt 18 as shown in FIG. 4 and the positioning fitting 31 for the earth pin 21 is fitted onto the skirt 18 and fixed at both ends to the fitting holders 32.

Figure 5:
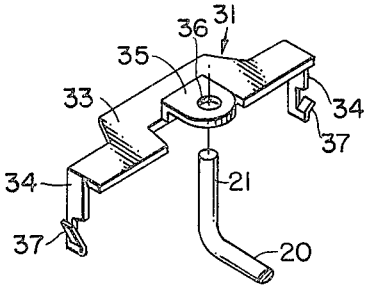
FIG. 5 is a perspective view of a positioning fitting in the same.

The positioning fitting 31, as shown in FIG. 5, is formed of a metallic plate, such as tin plate or steel plate, and comprises a substrate 33 bridged across both sides of skirt 18 and legs 34 bent from both ends of substrate 33 and integral therewith connected in a U-shape, the substrate 33 being provided at the center with a tongue 35 bent upwardly and having a through bore 36 into which the earth pin 21 is to be inserted.

Figure 6:
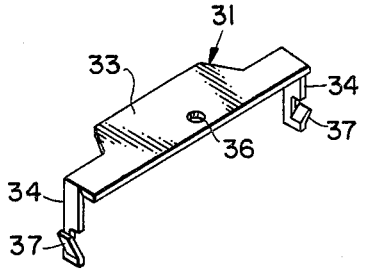
FIG. 6 is a perspective view exemplary of another fitting.

Another example of the positioning fitting 31, as shown in FIG. 6, is used when the skirt 18 projects more than the core 11, in which the substrate 33 is formed directly as a flat plate and has the through bore 36.

Figure 4:
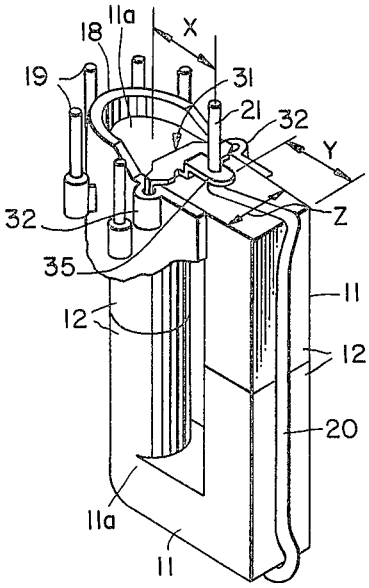
FIG. 4 is a perspective view of the principal portion in the FIG. 3 embodiment.

The fitting holders 32, as shown especially in FIG. 4, are each a cylinder in which is received a leg 34 of positioning fitting 31, the legs 34 each having at the free end a locking segment 37, for being press-fitted into the fitting holders for being locked therein.

Figure 7:
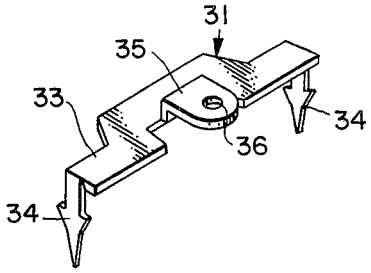
FIGS. 7 and 8 are perspective views exemplary of locking segments different in shape.
Figure 8:
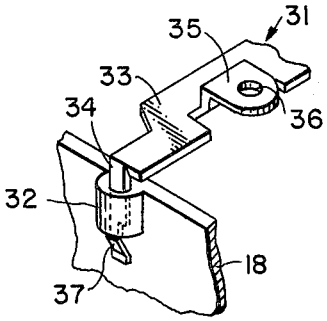

The positioning fitting 31, as shown in FIG. 7, may be fixed to the fitting holder 32 in such a manner that the free end of each leg is tapered to be sharp and urged into the holder 32, or may, as shown in FIG. 8, be elongated and have at the lower end a locking segment 37 so that the locking segment 37, when each leg 34 is inserted into the holder 32, passes therethrough and projects downwardly, thereby keeping the leg 34 in a locked condition.

Alternatively, an adhesive may be used together with the locking segment for fixing the positioning fitting 31 to the holders 32.

The flyback transformer of the invention constructed described is assembled as follows. First the primary winding 13 is wound onto the outer periphery of primary coil bobbin 14, the secondary winding 15 wound on the secondary coil bobbin 16 is sleeved on the primary winding 13, and the required lead wires of each winding are connected to the terminal pins 19. Then the ferrite cores 11 are inserted into the primary coil bobbin 14 from above and below, and the spring 20 is fitted elastically onto the outsides of both cores 11 to thereby couple both cores 11.

Next, the positioning fitting 31 is positioned between both side walls of skirt 18, the earth pin 21 is fitted into the through bore 36 provided in the substrate 33, and then both the legs 34 are press-fitted into the fitting holders 32 respectively.

Thereafter, the earth pin 21 may, if necessary, be soldered to the positioning fitting 31 and fixed thereto.

The positioning fitting 31 is fixed to the fitting holders 32 provided on the skirt 18 and the through bore 36 at the fitting 31 defines the position of earth pin 21, so that the position of earth pin 21 with respect to the group of terminal pins 19, in other words, the distance X between the axis of leg 12 of the core 11 carrying the primary coil bobbin and the earth pin 21 and the position Z of earth pin 21 widthwise of core 11, can be regularized.

In addition, at the outer periphery of each leg 12 of each core 11, on which the spring 20 is fitted, is provided a shallow groove usually for positioning the spring 20. In some cases, the positioning groove may be provided at the outer periphery of horizontal portion 11*a* at each core 11.

In the case where the groove is formed at the outer periphery of horizontal portion 11*a*, the positioning fitting 31 contributes mainly to positioning in the direction X.

As seen from the above, the earth pin integral with the core connecting spring can be held at a predetermined position, thereby improving the accuracy of positioning the earth pin and enabling the flyback transformer of the invention to be mounted reliably on the printed substrate.

What is claimed is:

1. A flyback transformer characterized in that a primary coil on a bobbin has fitting holders provided at both sides of a skirt formed integrally with a lower end of said primary coil bobbin, a U-shaped positioning fitting provided at the center with a through bore and fitted onto said skirt and fixed at both ends of said holders respectively, a spring fitted onto cores having legs inserted into said primary coil bobbin and abutting against each other, and a grounding pin bent from the lower end of said spring and fitted into said through bore of said positioning fitting.

2. A flyback transformer according to claim 1, wherein said positioning fitting is fixed to said fitting holders provided at said skirt, legs of said positioning fitting being provided with locking segments, and said legs being press-fitted into said holders respectively and locked therein.

3. A flyback transformer according to claim 1, wherein said positioning fitting is fixed to said fitting holders provided on said skirt, legs of said positioning fitting being sharpened at the tips and legs being press-fitted into said holders respectively.

4. A flyback transformer according to claim 1, wherein said positioning fitting is fixed to said fitting holders provided at said skirt, legs of said positioning fitting being elongated and provided at the free ends with locking segments projecting from the lower ends of said holders to lock said legs in said fitting holders.

* * * * *